United States Patent [19]

Moore

[11] Patent Number: 4,662,529

[45] Date of Patent: May 5, 1987

[54] BOTTLE WITH FRANGIBLE NECK AND CAP

[75] Inventor: Bertram Moore, Wigan, England

[73] Assignee: Schering Chemicals Limited, England

[21] Appl. No.: 834,746

[22] Filed: Feb. 28, 1986

[30] Foreign Application Priority Data

Feb. 28, 1985 [GB] United Kingdom ..... 8505237

[51] Int. Cl.[4] ..... B65D 1/02

[52] U.S. Cl. ..... 215/32

[58] Field of Search ..... 215/32, 250, 251, 252, 215/253

[56] References Cited

U.S. PATENT DOCUMENTS

| | | | |
|---|---|---|---|
| 4,096,962 | 6/1978 | Riuli et al. | 215/32 |
| 4,402,415 | 9/1983 | Hopley | 215/32 |
| 4,494,663 | 1/1985 | Bertaud et al. | 215/253 X |

FOREIGN PATENT DOCUMENTS 2080775 11/1983 United Kingdom .

*Primary Examiner*—Donald F. Norton

*Attorney, Agent, or Firm*—Ostrolenk, Faber, Gerb & Soffen

[57] ABSTRACT

A moulded plastics bottle for sterile liquids comprising (a) a threaded neck, the neck having a frangible annular portion above the threaded portion and also having an integral seal moulded onto the neck to close the bottle, and (b) a cap having a thread complementary with the thread of the neck, the cap containing an internal annular ring comprising at least two inwardly directed fingers which engage with the downward facing edge of the annular portion of the neck, whereby unscrewing of the cap causes upward movement of the fingers so that the frangible portion is broken and the seal is removed to reveal the contents of the bottle.

7 Claims, 4 Drawing Figures

Fig. 3.
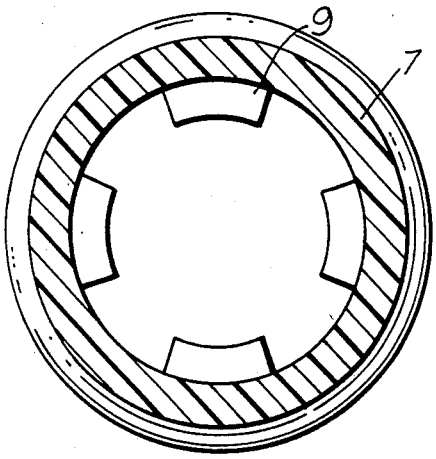
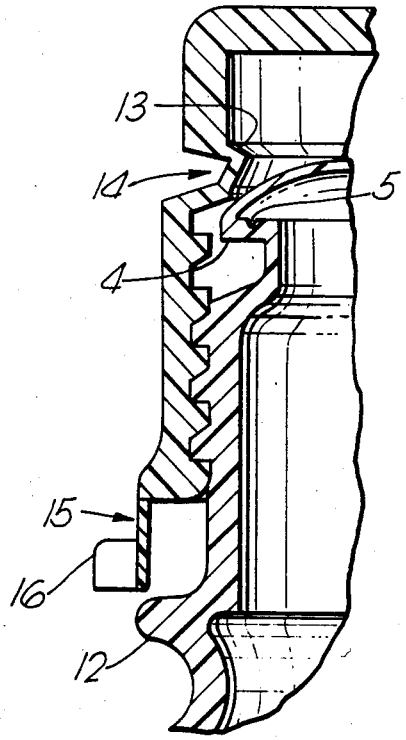
Fig. 4.

BOTTLE WITH FRANGIBLE NECK AND CAP

BACKGROUND OF THE INVENTION

This invention relates to plastic bottles for sterile liquids.

A large variety of bottles and related closure systems have been proposed. One such is that described in GB Pat. No. 2080775. In this a closure element, which is separately formed from the bottle, is heat sealed onto the neck of the bottle. The line where the closure is sealed onto the bottle is weaker than the rest of the bottle so that the closure can be broken off. This is achieved by having a jacking ring comprising fingers which snap into a recess above the heat seal and as the jacking ring is unscrewed upwards the cover is removed.

In another type of bottle shown in EP 50490 a cover is formed over the neck during the moulding operation. The threaded neck has an annular portion above the thread. During the moulding operation a V-shaped groove is formed in the annular portion to provide a frangible section. The bottle carries a cap, and is opened by screwing the cap downwards thereby breaking the frangible portion. A ring inside the upper part of the cap then locates inside an annular groove in the cover so that on unscrewing the cap, the sheared-off cover can be removed from the neck.

SUMMARY OF THE INVENTION

We have now devised an improved bottle which can be manufactured in a simple manner and which results in easy opening of the bottle.

Thus according to the invention there is provided a molded plastics bottle for sterile liquids comprising (a) a threaded neck, the neck having a frangible annular portion above the threaded portion and also having an integral seal moulded onto the neck to close the bottle, and (b) a cap having a thread complementary with the thread of the neck, the cap containing an internal annular array comprising at least two inwardly directed fingers which engage with the downward facing edge of the annular portion of the neck, whereby unscrewing of the cap causes upward movement of the fingers so that the frangible portion is broken and the seal is removed to reveal the contents of the bottle.

BRIEF DESCRIPTION OF THE DRAWINGS

The invention is illustrated with reference to the accompanying drawings in which:

FIG. 3 is a view of the cap only along the line AA in FIG. 2.

FIG. 4 is a partial side view of a bottle with a modified cap.

DESCRIPTION OF THE PREFERRED EMBODIMENTS

Figure 1:
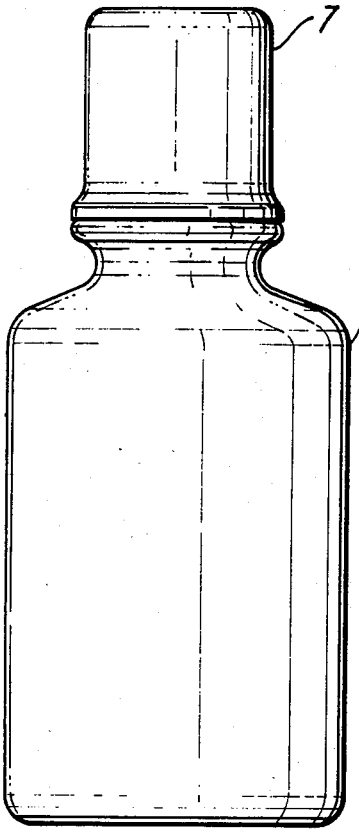
FIG. 1 is a side view of a bottle with the cap in position
Figure 2:
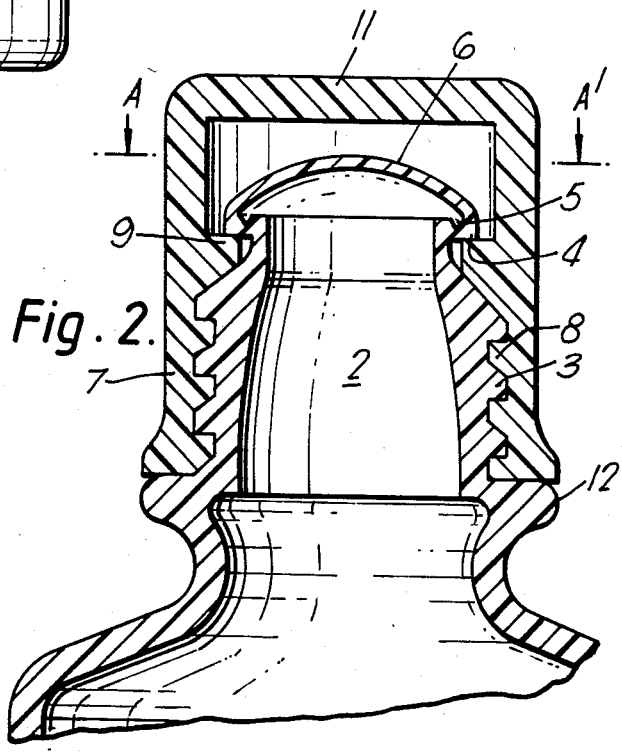
FIG. 2 is a sectional view of the neck of the bottle with the cap in position.

Referring to the drawings, the bottle 1 comprises a neck 2 having an external thread 3. An annular portion 4 has a V-shaped annular groove 5 above it, which makes the portion 4 at the top of the neck frangible. A seal 6 is molded onto the neck outward of the groove 5 to close the bottle. A cap 7, having an internal thread 8 complementary to the thread 3 of the neck, is screw fitted onto the neck. An annular array consisting of fingers 9 engage the annular portion 4. The fingers are sufficiently flexible to slide over the seal 6 as the cap is screwed into the position and then the fingers engage beneath portion 4, as shown in FIG. 2. Unscrewing the cap causes it to rise and the fingers break the frangible portion as they rise with the cap. The cover then continues upwards and is removed with the cap. The contents of the bottle can then be poured out.

In one embodiment of the invention the top portion of the cap 11, is sufficiently close to the seal 6 so that it is reasonably well contained by the cap. The cap can then be screwed back onto the bottle taking the seal with it and hence reseal the bottle. Downward movement of the cap is limited by an annular abutment 12 on the bottle below the neck.

The bottle is generally formed by blow molding a suitable plastics material e.g. polyethylene, polypropylene or polyethylene terephthalate. In the initial molding phase a neck portion is formed without a seal. The bottle is then filled with liquid.

The neck portion at this stage has sufficient plastic above the threaded portion so that the seal 6 can be formed from this remaining plastic in a second molding stage. During the second molding stage the V-shaped groove 5 is also formed by use of a suitable die. The seal is an integral part of the bottle.

In another embodiment shown in FIG. 4, the finger 13 is formed during molding of the cap. The cap is generally formed by injection molding. To form the finger, a ram is inserted to create a groove 14. A corresponding female tool shapes the finger. After the cap has been formed the tool can be collapsed and the ram withdrawn so that the cap can be removed from the mold. An annular tear-off band 15, which abuts abutment 12, prevents downward movement of the cap until the band has been removed. This removal is done by pulling on flange 16 which is attached to the band. To open the bottle, the band is torn off and the cap screwed down. As described for the previous embodiment, the fingers 13 are sufficiently flexible to slide over the seal 6. The fingers then engage the frangible portion 4 so that on unscrewing the cap, portion 4 breaks, as described previously, the seal can be removed and the contents of the bottle poured out.

Because in both embodiments, the fingers 9 or 13 directly engage the frangible portion of the neck a much cleaner break can be achieved, as compared for example with the bottle shown in GB 2080775, where fingers engage a groove remote from the frangible section. In this prior art bottle, as the jacking ring lifts the closure member, the closure member can stretch, so that breakage of the frangible section is not necessarily achieved in such a satisfactory manner.

I claim:

1. A molded plastics bottle comprising (a) a bottle body, an externally threaded neck on the body, the neck including an annular portion above the threaded portion, the annular portion projects radially outwardly and has a downwardly facing side facing toward the threads on the neck, the annular portion being frangible for breaking free of the neck upon force being applied to the downwardly facing side of the neck in a direction to lift the annular portion off the neck, and (b) a cap having an internal thread complementary with the external thread of the neck, the cap containing an internal annular array comprising at least two radially inwardly directed fingers which engage with the downwardly facing side of the annular portion of the neck upon unscrewing of the cap from the neck for causing upward movement of the fingers for breaking the frangible annular portion.

2. The bottle of claim 1, wherein the annular portion being frangible comprises a weakened connection between the annular portion and the neck of the bottle, whereby force applied to the annular portion by the fingers breaks the weakened connection.

3. The bottle of claim 1, wherein the annular portion has an upwardly facing side, the annular portion being frangible comprises a groove around the annular portion between the annular portion and the neck of the bottle and the groove being defined in the upwardly facing side of the annular portion for defining a frangible connection, whereby force applied to the downwardly facing side of the annular portion by the fingers breaks the frangible connection at the groove.

4. The bottle of claim 1, further comprising a seal for the necdk, the seal being integrally molded to the annular portion for closing the neck and the bottle and for being removed from the neck with the annular portion.

5. The bottle of claim 4, wherein the annular portion being frangible comprises a weakened connection between the annular portion and the neck of the bottle, whereby force applied to the annular portion by the fingers breaks the weakened connection, the seal being attached to the annular portion radially outwardly of the weakened connection between the annular portion and the neck.

6. The bottle of claim 2, further comprising an abutment on the neck disposed for blocking the threaded tightening of the cap down on the neck beyond the height at which the fingers are generally directly beneath the downwardly facing side of the annular portion.

7. The bottle of claim 6, further comprising a removable strip at the bottom of the cap which blocks the cap from being tightened onto the neck sufficiently to bring the fingers beneath the downwardly facing side of the annular portion and the removable strip being of a height such that following its removal, the cap may be tightened to bring the fingers beneath the downwardly facing side of the annular portion.

* * * * *